United States Patent [19]

Johansson

[11] 4,141,414

[45] Feb. 27, 1979

[54] DEVICE FOR SUPPORTING, RAISING AND LOWERING DUCT IN DEEP BORE HOLE

[76] Inventor: Sven H. Johansson, Saah-Scania Aktiebolag, Linköping, Sweden, S581 88

[21] Appl. No.: 848,220

[22] Filed: Nov. 3, 1977

[30] Foreign Application Priority Data

Nov. 5, 1976 [SE] Sweden ..... 7612372

[51] Int. Cl.[2] ..... E21B 1/08; E21B 3/12

[52] U.S. Cl. ..... 166/212; 175/94; 175/99; 299/31

[58] Field of Search ..... 166/55.8, 120, 187, 166/212; 175/94, 99, 267; 24/263 DH; 254/134.6; 299/31

[56] References Cited

U.S. PATENT DOCUMENTS

| | | | |
|---|---|---|---|
| Re. 28,449 | 6/1975 | Edmond | 175/94 |
| 3,407,884 | 10/1968 | Zygmunt et al. | 173/91 |
| 3,554,603 | 1/1971 | Emden et al. | 175/99 X |

*Primary Examiner*—Ernest R. Purser
*Assistant Examiner*—Nick A. Nichols, Jr.
*Attorney, Agent, or Firm*—James R. Custin

[57] ABSTRACT

A duct section or other load to be moved axially along a bore hole has two reciprocating drivers mounted on it and two sets of gripping elements. Each driver reacts axially between the load and a set of gripping elements to move the gripping elements relative to the load through a defined stroke in each axial direction. An endless cable with axially extending straight stretches has one stretch connected to each driver to constrain the drivers always to move in opposite axial directions and to begin and end their strokes simultaneously. The gripping elements are so formed that when engaged with the surface of a bore hole, increasing axial force on the load in one direction increases the radially outward force under which they bite into the surface. At each end of a driver stroke the gripping elements collide with abutment members of a direction control device, whereby gripping elements engaged with the bore hole surface are forced out of such engagement and disengaged gripping elements are forced against that surface. The abutment members are arranged in two sets, one set to coordinate gripping element engagement and disengagement for transporting the load in one axial direction, the other set for transportation in the opposite direction. Positioning the directional control device at one or the other limit of its rotation brings one or the other set of abutment members into use.

3 Claims, 17 Drawing Figures

21U

21N

DEVICE FOR SUPPORTING, RAISING AND LOWERING DUCT IN DEEP BORE HOLE

This invention relates to apparatus for drilling very deep bore holes into the earth, and is more particularly concerned with apparatus by which a duct or shaft that extends along the length of a bore hole and is supported by reaction against the side surface of the bore hole is moved upwardly and downwardly to raise and lower a drilling mechanism that is connected to the bottom of the duct. The subject matter of this application is closely related to that of the applicant's copending application, Ser. No. 848,219, filed Nov. 3, 1977.

For drilling a very deep bore hole into the earth, a drilling mechanism working at the bottom of the bore hole must be communicated with the surface by means of a shaft or duct that extends along the length of the bore hole. In prior apparatus for deep drilling, the drilling mechanism comprised a fluid pressure motor that was directly coupled to a bit or bits to drive the same, and the duct that extended down the bore hole carried pressure fluid to the motor. Exhaust fluid from the motor was returned up the bore hole externally of the duct, carrying with it debris loosened by the drilling mechanism. In such prior apparatus the duct was supported at the surface of the earth and hung down into the bore hole, and therefore drilling depth was limited to something less than the so-called breaking length of the duct. If the length of the duct exceeded a certain limit — usually somewhat less than 6,000 meters — the weight of the duct would exceed its tensile strength and the duct could be expected to break. Hence the maximum depth to which a bore hole could be drilled has heretofore been less than 6,000 meters.

Apparatus that enables bore holes to be drilled to depths substantially greater than 6,000 meters makes possible the utilization of geothermal energy in non-volcanic regions. It is estimated that temperature in the primary rock formation rises about 30° C. per kilometer of depth. In a bore hole drilled to a depth of about 10,000 m., water or a similar fluid heat transfer medium, circulating in a closed system, can be forced down to abstract heat energy from the rock formation and back up to the surface for utilization of its heat energy content. Thus the capability for drilling to such depths has great potential value in making available an inexhaustable energy source.

The applicant's copending application, Ser. No. 848,219, filed Nov. 3, 1977, generally covers apparatus which makes possible the drilling of such extremely deep bore holes. In that apparatus there is an air-tight lining in the upper portion of a bore hole to be deepened, extending through porous and fissured rock formations and a short distance down into dense, air-tight bedrock; and there is an air lock in the uppermost portion of the bore hole. Extending up through the entire length of the bore hole is a duct, made up of endwise connected, readily disconnectable duct sections, and the upper end of that duct, which projects through the air lock, is open to the atmosphere. The portion of the bore hole below the air lock and external to the duct is pressurized, and a pneumatic motor that drives the drill bit or drill bits has its pressure air inlet open to the bore hole outside the duct and its exhaust air outlet communicated with the interior of the duct.

Instead of being suspended from the surface, the duct is supported by means of supporting and moving devices which are fixed to duct sections at intervals along its length and which have gripping elements that frictionally engage the side surface of the bore hole. The drilling mechanism has a telescoping connection with the bottom of the duct so that it can deepen the bore hole to some extent by moving downwardly relative to the duct while the duct remains stationary. However, when the drilling mechanism has worked down to the limit of extension of the telescoping connection, the duct must be lowered through a distance sufficient to contract the telescoping connection and allow drilling to continue. It is also necessary that the drilling mechanism be brought up to the surface from time to time, so that worn drill bits can be exchanged for sharp ones. For this purpose, the duct must be raised as well as lowered, to carry the drilling mechanism up and down the bore hole with the duct by means of its telescoping connection with it.

Heretofore no satisfactory device has been known whereby an upright duct can be supported from the side surface of a bore hole and, by reaction against that side surface, can be confined against motion or be moved upwardly or downwardly, as desired.

U.S. Pat. No. 2,946,578 disclosed a machine having coaxial front and rear portions, the front portion comprising a drilling mechanism and the rear portion being provided with axially spaced sets of inflatable cushions. The cushions of each set were arranged around the machine in such a manner that, when inflated, they frictionally engaged the side surface of the bore hole in which the machine was working, and when deflated they were clear of that surface. The respective sets of cushions were attached to parts of the machine that were axially movable relative to one another. Therefore, with a first set of cushions inflated, the part of the machine carrying an adjacent second set of uninflated cushions could be moved axially towards or away from the inflated set. The second set of cushions could then be inflated, after which the first set of cushions could be deflated and moved axially in the same direction relative to the second set. In this way the machine could propel itself in each direction along a bore hole, or maintain a fixed position.

In a pressurized bore hole, inflation of the cushions would have presented a problem. Furthermore, the apparatus was not suitable for use in vertical bore holes because the frictional engagement between its cushion surfaces and the bore hole surface would not have provided enough grip to support any substantial amount of weight.

U.S. Pat. No. 3,185,225 disclosed apparatus for feeding a drilling mechanism in the direction in which boring progressed. The apparatus comprised two sets of anchor assemblies that were sequentially operable, so that each set, in turn, could be engaged with the bore hole surface while the other set of anchor assemblies, which was retracted to be radially spaced from the bore hole surface, moved axially through a short distance in the drilling direction. Each anchor assembly comprised a plurality of elongated beam-like members that extended lengthwise of the bore hole and engaged the bore hole surface at intervals around it. Since the apparatus of U.S. Pat. No. 3,185,225 could move along the bore hole only in the drilling direction, it had to be withdrawn from the bore hole by means of a cable or the like that was supported from the surface, and consequently it was not suitable for use in drilling very deep bore holes. Furthermore, the beam-like members could not be relied upon to grip the surface of a vertical bore hole securely enough to support any substantial amount of weight.

U.S. Pat. No. 3,827,512 disclosed another apparatus intended to force a drilling mechanism in a feed direction, comprising two sets of claw-like anchors. When the anchors of one set engaged the bore hole surface, those of the other set were radially spaced from that surface and were moved bodily in an axial drill feeding direction relative to the engaged set. Each of the anchors was so formed and arranged that when it was engaged with a bore hole surface, the axial reaction to drilling feed force was translated into a radially outward force upon the claw-like anchor, whereby the anchor tended to bite more deeply into the bore hole surface with increasing feed force. As one set of anchors advanced the drilling mechanism, the other set of anchors tended to be disengaged from the bore hole surface by axial force in the drill feeding direction. Thus, the anchors could only be effective to advance the machine in the drilling direction. The patent suggested that the machine could be made to back itself out of a horizontal bore hole under its own power by means of a second apparatus, comprising another two sets of anchors, arranged back-to-back with the first one. However, this back-to-back arrangement would not have been operative in a vertical bore hole because gravity would apply a constant downward force to any set of anchors engaged with the bore hole surface to support the machine against sliding downwardly, and once the anchors had been so engaged, there would have been no way to retract them to allow the machine to move downwardly.

The present invention solves the problem of providing a device by which a duct that extends along a deep vertical bore hole in the earth can be supported by reaction against the bore hole surface both for confinement against motion relative to the bore hole and for motion in the bore hole, upwardly as well as downwardly, said device being well suited for remote control and for being powered by air in the bore hole under substantially higher pressure than air in the duct supported by the device, so that the device can be employed without the need for additional duct or hose that extends down the bore hole to it. More specifically, the present invention solves the problem of providing gripping elements or claw-like anchors in such a device that tend to bite more deeply into the bore hole surface with increasing downward force but which can nevertheless be quickly and automatically disengaged from that surface for controlled downward movement of the device.

In general, therefore, the ultimate object of the invention is to provide apparatus that makes possible the drilling of extremely deep bore holes into the earth, so that geothermal energy and other resources lying very far beneath the surface can be utilized.

More specifically, it is an object of the invention to provide a device that is fixed to one of a plurality of endwise connected duct sections extending along a bore hole and has gripping elements which bitingly engage the side surface of the bore hole for support, which device comprises a remotely controllable pneumatic actuator for said gripping elements, with a pressure air inlet in the bore hole externally of the duct section and an exhaust air outlet communicated with the interior of the duct section, said actuator providing for actuation of the gripping elements in such a manner that, depending upon control signals received at the device, the duct section is confined against motion in the bore hole, or is moved upwardly, or is moved downwardly.

A further and still more specific object of the invention is to provide a device of the character described that is capable of being remotely controlled by a relatively simple system of sound signals or other radiations by which the device is selectively caused to maintain its position in a bore hole, to move downwardly along the bore hole, or to move upwardly along it.

It is also a specific object of the invention to provide a duct supporting device of the character described wherein there are two sets of gripping elements or anchors which can be extended for bitingly gripping a bore hole surface or can be retracted to be clear of the bore hole surface; wherein the gripping elements are so formed and arranged that when they are engaged with a bore hole surface, a radially outward biting force that they exert against it tends to be increased by the force of gravity; wherein one set of gripping elements is always engaged with the bore hole surface while the other set is moved axially in one direction or the other along the bore hole; and wherein simple but effective means automatically effects positive disengagement of each set of gripping elements from the bore hole surface as soon as the other set has been engaged with that surface, so that the newly-disengaged set of gripping elements can be moved axially in either direction relative to the newly-engaged set.

Another specific object of the invention is to provide a device of the character described having gripping elements that are arranged in two sets, each set being movable axially relative to the other set of gripping elements and relative to a load supported by the device, wherein an actuator for the gripping elements comprises two reciprocating drivers, each of which carries a set of gripping elements for axial motion relative to the supported load; wherein each of the drivers comprises a plurality of double-acting pneumatic cylinder motors; and wherein simple means are provided for constraining the several cylinder motors that comprise each reciprocating driver to operate in unison and to constrain the two drivers always to move in opposite directions through predetermined strokes and to begin and end their respective strokes simultaneously.

In general, the invention accomplishes these and other objectives with a device that comprises two sets of gripping elements, the gripping elements of each set being arranged to bitingly engage a bore hole surface under a radially outward force that increases with increasing axial force in one direction; a pair of axially reciprocable, pressure fluid energized drivers, each connected between a set of gripping elements and a load to be transported along a bore hole and arranged to effect movement of the set of gripping elements relative to the load through a defined stroke in each axial direction; means connected between the drivers to constrain them always to move in opposite axial directions and to begin and end their strokes simultaneously; and a directional control device which is movable between defined limits in opposite directions transverse to the direction of driver reciprocation and which comprises two sets of abutment members that are engaged by the gripping elements at the ends of the driver strokes and whereby those gripping elements that are out of engagement with the bore hole surface are forced into engagement therewith and those gripping elements that are engaged with that surface are forcefully disengaged from it, one of said two sets of abutment members being positioned for engagement by the gripping elements when the directional control device is at one of its said defined limits and being arranged to coordinate engagement and disengagement of the gripping elements for transportation of the load in one direction along the bore hole, and the other of said sets of abutment members being positioned to be engaged by the gripping elements when the directional control device is at the other of its limits of motion and being arranged to coordinate engagement and disengagement of the gripping elements for motion in the opposite direction along the bore hole.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 1 is a view in longitudinal section of a lower portion of a deeply drilled bore hole wherein the apparatus of the present invention is being utilized for further deepening the bore hole;

FIG. *2a* is a view on a larger scale, partly in side elevation and partly in longitudinal section, take at line II—II in FIG. 1 and illustrating one of the devices of this invention in its condition for effecting a first stage of downward movement;

FIG. *2b* is a view similar to FIG. *2a* but illustrating the device in its condition for effecting a first stage of upward movement;

FIG. *2c* is a view similar to FIG. *2a* but illustrating the device in its condition for effecting a second stage of downward movement;

FIG. *2d* is a view similar to FIG. *2a* but illustrating the device in its condition for effecting a second stage of upward movement;

Figure 9:
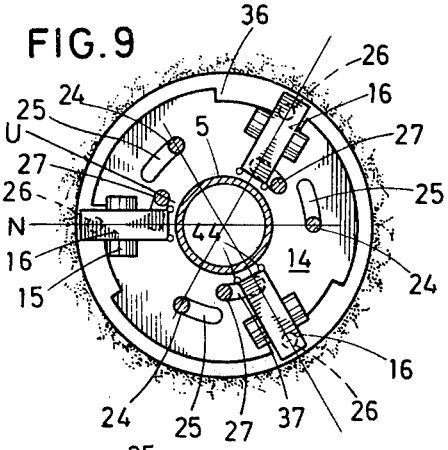
Figure 10:
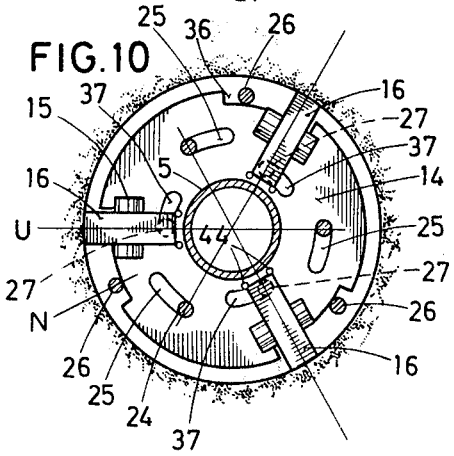

FIGS. 9 and 10 are views in cross section taken on the plane of the lines 9—9 and 10—10 in FIGS. *2a* and *2b;*

Figure 8:
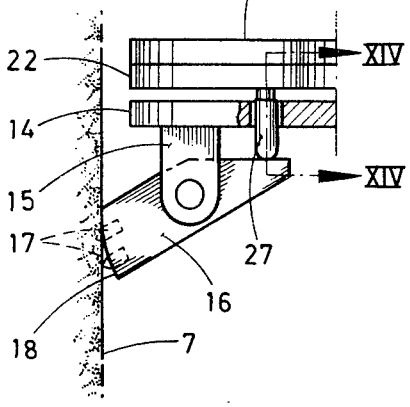
FIG. 8 is a view of one of the gripping elements shown in its relationship to portions of the device that are adjacent to it and to the side surface of a bore hole.
Figure 12:
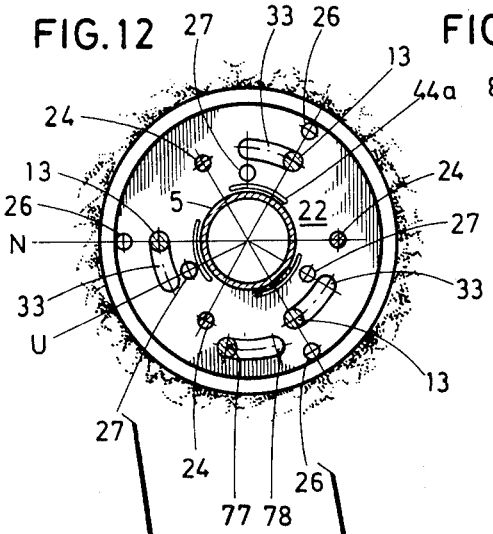
Figure 11:
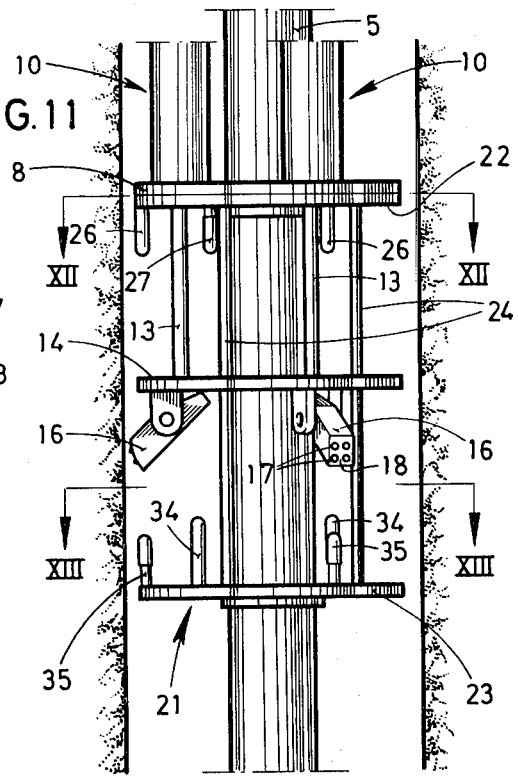
Figure 13:
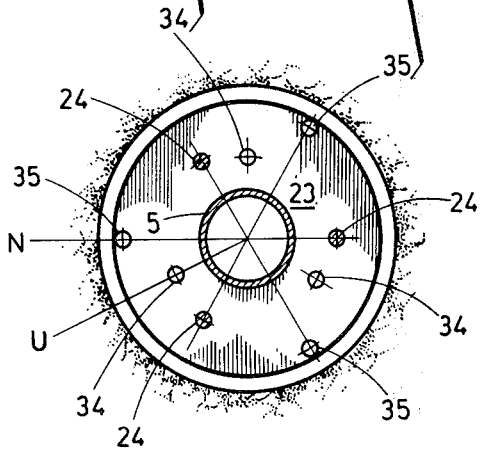
Figure 14:
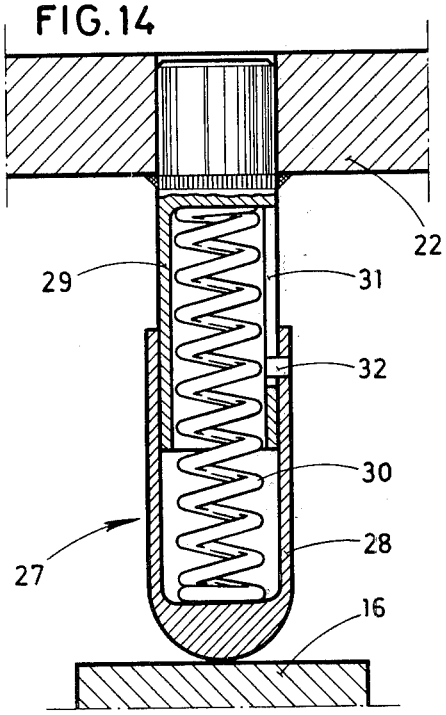
Figure 2A:
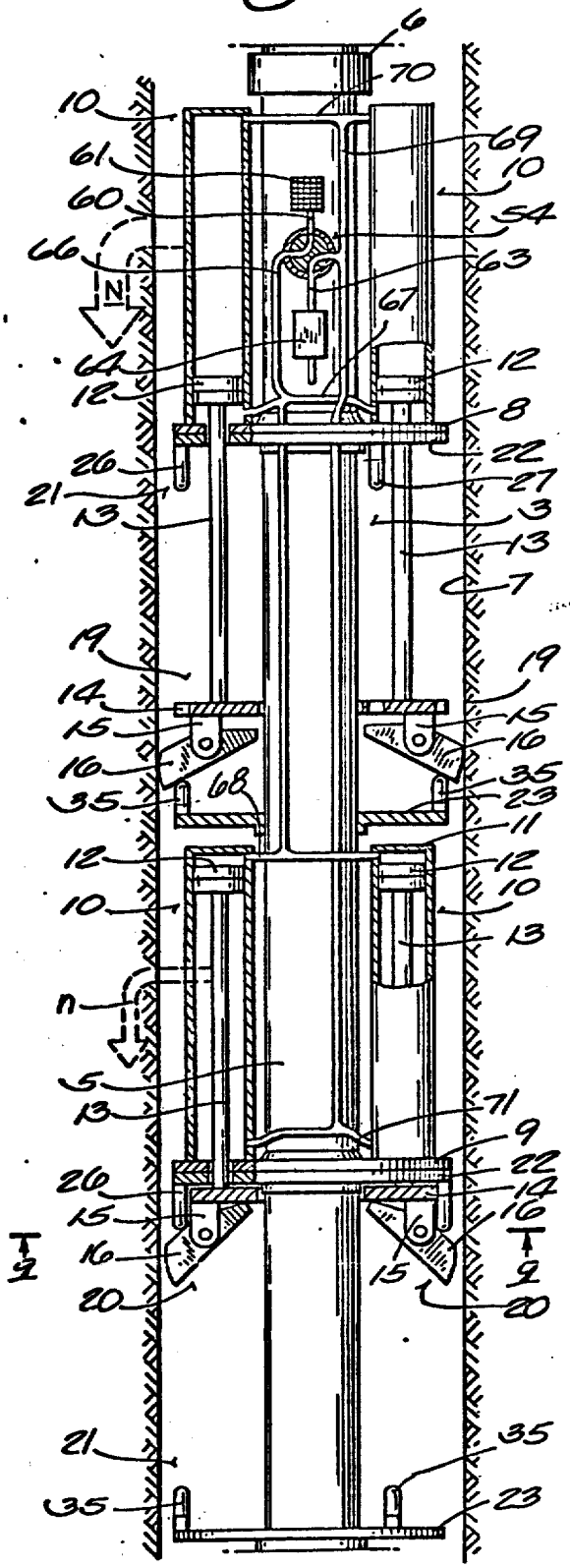
Figure 2B:
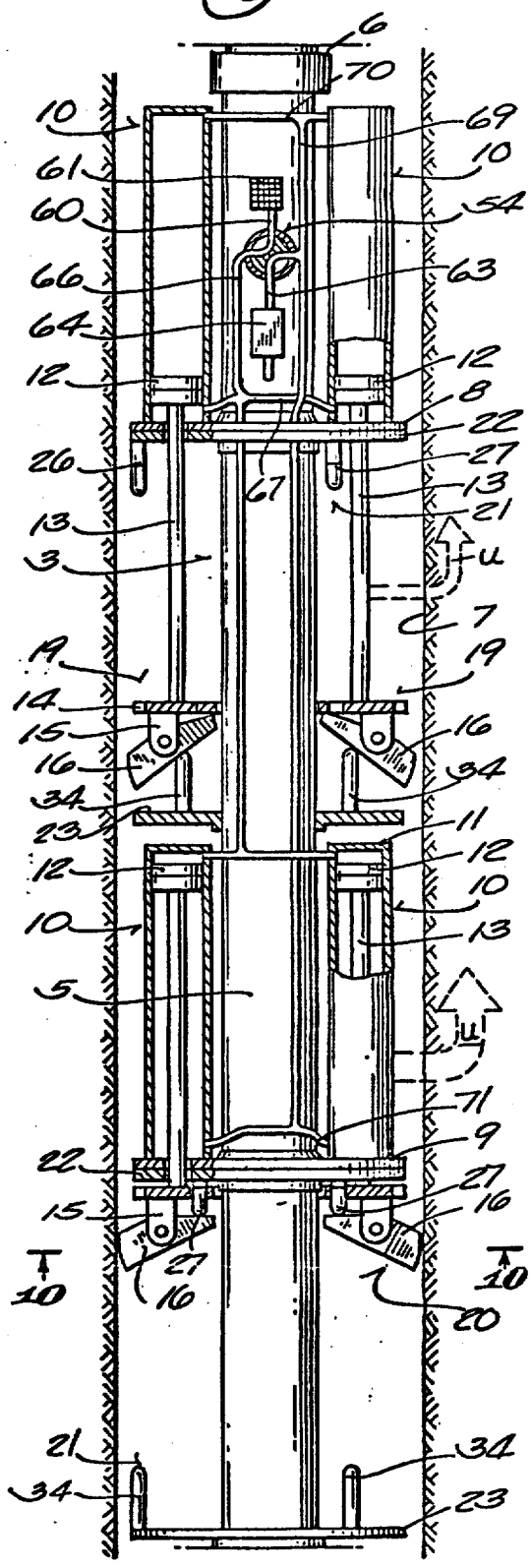
Figure 2C:
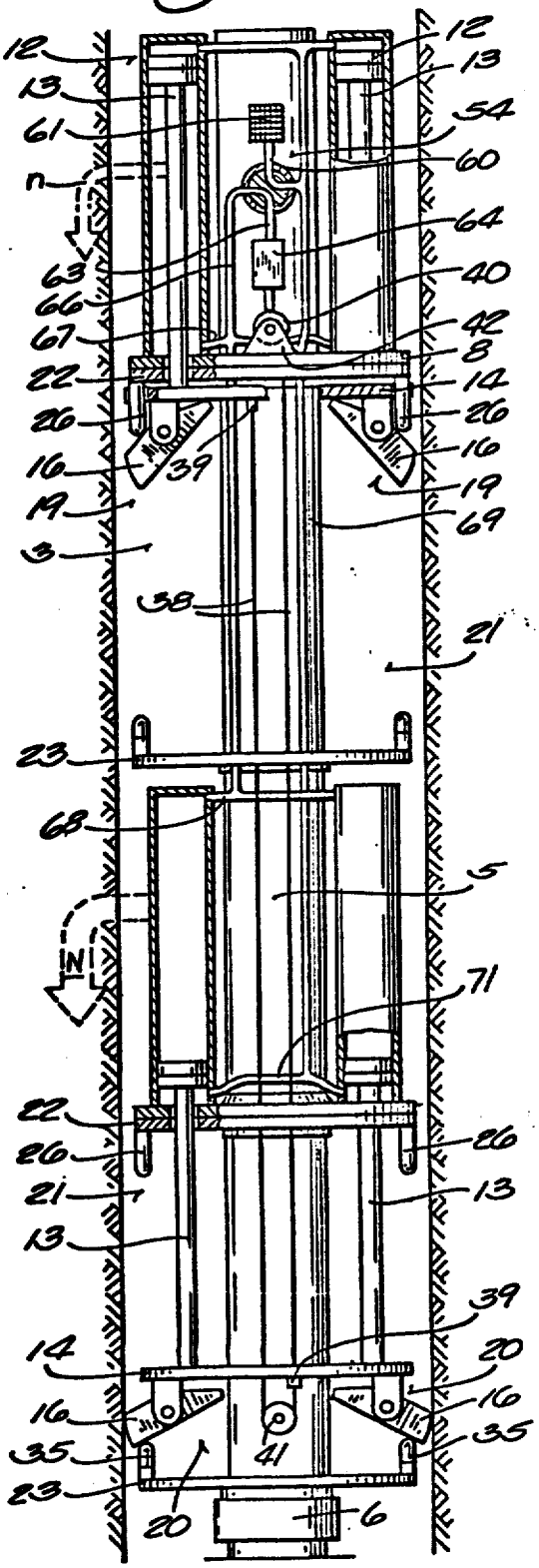
Figure 2D:
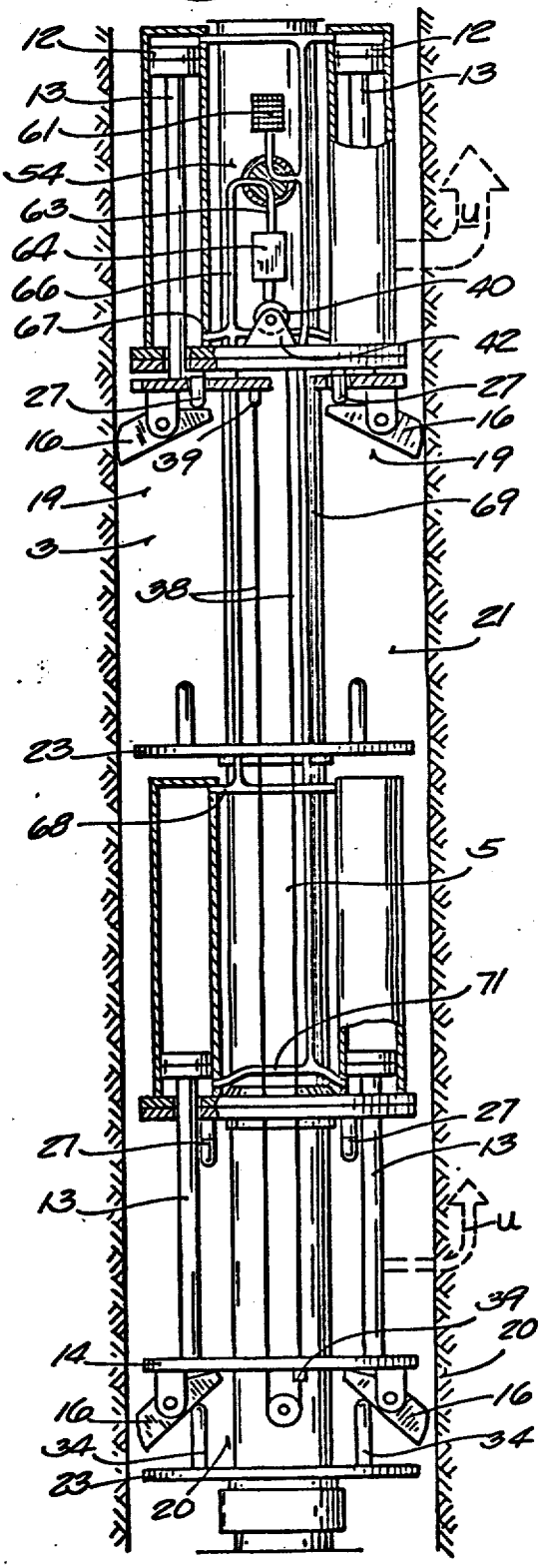

FIG. 11 is a view in side elevation of that portion of the device that effects control of the direction of its movement along a bore hole;

FIGS. 12 and 13 are views in cross section, respectively taken on the plane of the line XII—XII and the plane of the line XIII—XIII in FIG. 11; and FIG. 14 is an enlarged view in longitudinal section of one of the yielding abutment pins of the device, taken on the plane of the line XIV-XIV in FIG. 8.

Figure 1:
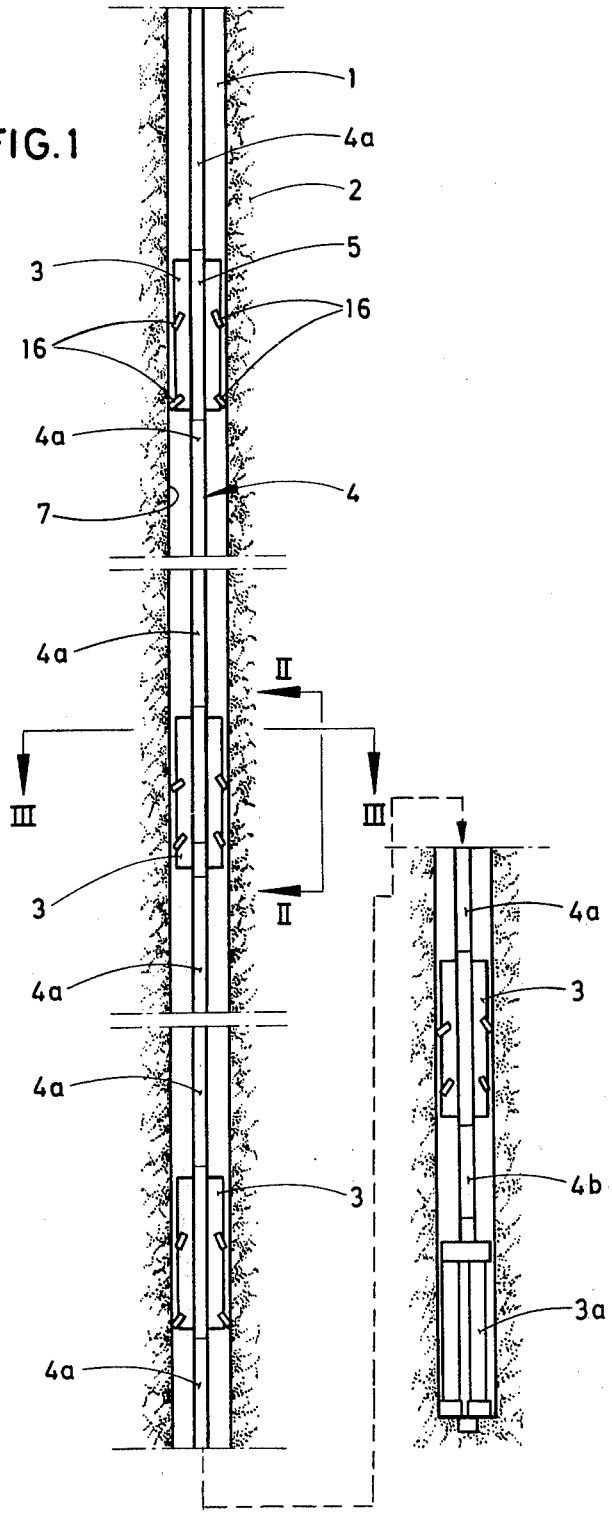

Referring now to the accompanying drawings, and first considering FIG. 1, the numeral 1 denotes a portion of a bore hole which has been drilled into dense, air-tight bedrock or primary formation 2 and which is being further deepened by means of a drilling mechanism *3a*. Certain details of the apparatus employed for deepening the bore hole 1 are not shown in FIG. 1 because they do not relate directly to the present invention and are fully disclosed in the above-mentioned companion application, Ser. No. 848,219, to which reference may be made for further information.

In general, a duct 4 that extends through the full height of the bore hole has at its bottom a telescoping connection *4b* with the drilling mechanism whereby the drilling mechanism is allowed to move up and down between defined limits relative to the duct. The upper portion of the bore hole (not shown) has an airtight lining and is provided with an air lock, so that the illustrated portion of the bore hole 1, except for the interior of the duct 4, can be pressurized with pressure air from a source at the surface of the earth. The duct 4 has its upper portion projecting through the air lock and has its top end open to the atmosphere. The drilling mechanism can therefore have its drill bit or drill bits driven by a pneumatic motor that has a pressure air inlet open to the bore hole externally of the duct 4 and an exhaust air outlet communicated with the interior of that duct. Furthermore, since the interior of the duct 4 represents a suction source relative to the pressurized air in the bore hole, boring debris loosened by the drilling mechanism can be sucked into the duct 4 and blown up through it to the surface by the exhaust air from the pneumatic drill motor.

The duct 4 is made up of endwise connected duct sections, certain of which can be identical plain sections *4a*. However, at regular intervals along the duct it has duct sections 5 which incorporate supporting and moving devices 3 of this invention, by which the duct is supported from the side surface 7 of the bore hole (instead of being suspended from a support at the earth's surface, as in prior apparatus), and by which the duct can be maintained stationary in the bore hole, for drilling, or can be raised or lowered for changing of drill bits. The several duct sections *4a*, 5 are so connected with one another, as by means of collars 6, that individual sections can be readily attached to the upper end of the duct 4 as it is moving downwardly in the bore hole or can be taken off of it as the emerge from the bore hole when the duct is being raised. The connections between adjacent duct sections are of course air-tight. To facilitate handling the special duct sections 5 that incorporate the devices 3, they can be substantially shorter than the plain duct sections *4a*, but their inside and outside diameters are uniform with those of the plain duct sections and their end portions are formed for identical connections with adjacent duct sections.

Referring now to FIGS. *2a–2b* through 14, each of the devices 3 comprises, in general, a plurality of gripping elements 16 for engagement with the side surface 7 of the bore hole and a hereinafter described pneumatic actuator for the gripping elements that receives pressure air from the bore hole, outside the duct 4, and discharges exhaust air into the interior of the duct 4. It will be understood that the pneumatic actuator could equally well receive its pressure air through a hose or duct extending along the bore hole and could vent its exhaust air into the bore hole, but because it cooperates nicely with a pressurized bore hole arrangement that is uniquely suited for deep drilling, it will be so described herein. It will also be understood that the duct section 5 is merely representative of any one of several types of loads that could be moved along a bore hole by means of the device 3 of this invention. The load could comprise, for example, a capsule containing measuring instruments or radioactive material to be buried. Furthermore, the device 3 is here described in relation to its use in a vertical bore hole, where the advantages of the present invention are most apparent, but it will be evident that the device 3 could be readily adapted for use in horizontal and inclined bore holes.

The above mentioned pneumatic actuator comprises a plurality of double-acting pneumatic cylinder motors 10, arranged in two sets which are spaced from one another along the length of the duct section 5. There are preferably three pneumatic cylinder motors 10 in each set, all with their axes parallel to that of the duct section 5, and all spaced at uniform radial distances from the duct section 5 and spaced apart by uniform circumferential intervals. (In FIGS. *2a–2b* and *2c–2d*, cylinder motors are shown, for simplicity, as located at diametrically opposite sides of the duct section 5, but the actual preferred arrangement is correctly shown elsewhere in the drawings). Each cylinder motor 10 comprises a cylinder 11 and a piston 12 that is slideable up and down in the cylinder and has a downwardly projecting piston rod 13. The cylinders 11 of the cylinder motors of the upper set are secured to the duct section 5 by means of an annular plate 8 which is coaxially fastened to that duct section and to which the lower ends of said cylinders 11 are secured. In like manner, the cylinder motors of the lower set have the lower ends of their cylinders 11 secured to a similar annular plate 9 that is fastened to the duct section 5. Each of the securement plates 8 and 9 has an outside diameter substantially smaller than the bore hole diameter, to be well clear of the side surface of the bore hole.

The gripping elements 16 are arranged in an upper group 19 and a lower group 20. The gripping elements of each group are connected with the piston rods 13 of the upwardly adjacent set of cylinder motors by means of a substantially annular carrying plate 14 that surrounds the duct section 5 with some clearance and is rigidly secured to the bottom ends of the downwardly projecting piston rods. Thus the cylinder motors 10 of each set, unified by the carrying plate 14 to which their piston rods 13 are connected, comprise with that carrying plate an axially reciprocating pneumatic driver for a group 19 or 20 of gripping elements 16.

Each such pneumatic driver can carry its group 19, 20 of gripping elements for axial motion relative to the duct section 5 through strokes defined by the stroke limits of its pistons 12. For transporting the duct section 5 along the bore hole, it is necessary to so coordinate the operations of the two reciprocating drivers that each group 19, 20 of gripping elements is always moved in the direction opposite to the direction of movement of the other group, and the two drivers begin and end their strokes simultaneously. To this end, the upper and lower carrying plates 14 are connected with one another by means of three coordinating devices, located adjacent to the duct section 5 and spaced apart at uniform circumferential intervals around it, each coordinating device comprising an endless steel cable 38 trained around upper and lower freely rotatable pulleys 40 and 41. The upper pulley 40 (see FIGS. *2c–2d*, 4 and 5) is journaled in a bearing support 42 that is fixed between the duct section 5 and a pair of motor cylinders 10, above the upper cylinder supporting plate 8. The lower pulley 41 is located a substantial distance below the upper one, in vertical alignment with it, and is freely rotatable on a suitable bearing support (not shown) that can be fixed to the duct section 5. The endless cable 38 that is trained around the pulleys 40 and 41 thus has long straight stretches that extend between the pulleys, and motion of either stretch in either axial direction imparts equal but opposite motion to the other. One of those straight stretches of the cable 38 is anchored to the upper carrying plate 14 by means of a securement 39, and the other is similarly anchored to the lower carrying plate 14. The upper cylinder supporting plate 8 has holes 43 through which the cable stretches pass, and each of the carrying plates 14 has similar holes 44.

Each carrying plate 14 carries at least three of the gripping elements 16. Each gripping element is supported on a bracket 15 that projects down from the underside of its carrying plate 14, directly beneath one of the piston rods 13. As best seen in FIG. 8, each gripping element is somewhat elongated and is so connected with its bracket 15 as to be swingable up and down about a horizontal axis intermediate its ends and transverse to its length. The gripping elements on each carrying plate 14, and the brackets 15 that support them, are spaced at uniform distances from the axis of the duct section 5 and at uniform circumferential intervals around the carrying plate. (Although FIGS. *2a–2b* and *2c–2d* show gripping elements at diametrically opposite sides of the duct section 5, this is for simplicity, and it is preferred that there be three gripping elements in each group, arranged as shown elsewhere in the drawings.)

Each of the carrying plates 14 has an outside diameter substantially smaller than the diameter of the bore hole, to be well clear of the bore hole surface 7. However, the gripping elements 16 are so arranged that each has its length oriented radially to the duct axis, and each has an outer end portion which projects a distance beyond the outer edge of its carrying plate 14, for engagement with the bore hole surface. At its outer end, as best seen in FIGS. 8 and 11, each gripping element is formed with a biting surface 18 from which spurs project that are defined by the pointed ends of hard metal pins 17 set into the gripping element.

Note that the gripping elements 16 are so formed that their biting surfaces 18 are located below their swinging axes as well as radially outwardly from those axes, so that the force of gravity, acting at the connections of the gripping elements to their brackets 15, tends to exert a radially outward force component on the outer ends of the gripping elements by which they are urged into more secure biting engagement with the bore hole surface 7. Attention is also directed to the fact that the outer ends of the gripping elements, at which their biting surfaces 18 are located, are biased downwardly, so that when those biting surfaces are disengaged from a bore hole surface the outer ends of the gripping elements swing downwardly and away from the bore hole surface and thus tend to remain clear of that surface. As shown, such downward bias is imposed upon the gripping elements by gravity inasmuch as their outer end portions are heavier than their inner end portions.

It will be generally apparent at this point that during the coordinated operation of the reciprocating drivers comprised of the pneumatic motors 10, the duct section 5 can be moved either upwardly or downwardly in the bore hole by causing the gripping elements of each group 19 and 20 to engage and disengage the bore hole surface 7 in proper coordination with the strokes of the drivers. The means for effecting properly timed and properly coordinated engagement of gripping elements with the bore hole surface and disengagement of gripping elements from that surface comprises a directional control device which is generally designated 21 and which is best seen in FIGS. 11–13. There is, in fact, a directional control device 21 for each group 19, 20 of gripping elements, but, as explained hereinafter, the two directional control devices are coordinated to act as one.

Each directional control device (they are identical) comprises an upper annular rotatable plate 22, a lower annular rotatable plate 23 and a plurality of spacers or tie rods 24 that hold the rotatable plates 22 and 23 in fixed axially spaced relation to one another and constrain them to rotate in unison. (For simplicity, the spacers 24 are not shown in FIGS. *2a–2b* and *2c–2d* but are shown in FIGS. 11–13.) The annular plates 22 and 23 are coaxial with the duct section 5 and, by suitable supporting and bearing means (not shown), they are confined to rotation through a predetermined angle. The upper rotatable plate 22 directly underlies its adjacent cylinder supporting plate 8 or 9 and is thus located above the annular carrying plate 14 for its group 19 or 20 of gripping elements 16; whereas the lower rotational plate 23 is located a distance below that carrying plate. The vertical distance between the rotatable plates 22 and 23 is sufficient to allow the carrying plate 14 to move between them through the full stroke of the pistons 12. To allow the spacers 24 to extend through the carrying plate 14 and to move with rotation of plates 22 and 23, the plate 14 has short arcuate slots 25 (see FIGS. 9 and 10) through which the spacers 24 freely pass. And, since each rotatable plate 22 is located between a cylinder supporting plate 8 or 9 and a carrying plate 14, each rotatable plate 22 has arcuate slots 33 through which the piston rods 13 freely pass, as best seen in FIG. 12. As may also be seen in FIG. 12, the upper rotatable plate 22 has further arcuate slots 44*a* through which pass the straight stretches of the endless driver coordinating cables 38.

Each rotatable directional control device 21 provides for downward motion of the duct section 5 when it is at one limit of its rotation, designated N in FIGS. 9, 10, 12 and 13; and at its other limit of rotation, designated by U in those figures, it provides for upward movement of the duct. At each limit of its rotation the directional control device brings certain of a plurality of abutment pins 26, 27, 34, 35 into alignment with the gripping elements 16 on the gripping element carrier plate 14 that is between its rotatable plates 22, 23; and as the gripping elements, carried by the piston rods 13, are moved upwardly or downwardly relative to the directional control device, the gripping elements engage the abutment pins that are aligned with them and, by such engagement, are swung into or out of engagement with the bore hole surface 7, as circumstances require. The specific manner in which this takes place for each direction of duct movement will appear from the following explanation.

On the underside of the upper rotatable plate 22 there are two groups 26, 27 of downwardly projecting abutment pins, in an arrangement best seen in FIG. 12. The abutment pins of one group, designated by 26, are rigid and are so located radially and circumferentially on the rotatable plate 22 that when that plate is in its N (downward) position of rotation, illustrated in FIG. 9, each of the abutment pins 26 can be engaged by the outer end portion of a gripping element 16 therebeneath. Such engagement occurs during upward movement of the carrying plate 14, near the top of its stroke, and causes the outer end of the gripping element to swing downwardly, away from engagement with the bore hole surface 7, as can be seen in the lower part of FIG. *2a* and the upper part of FIG. *2c*. To enable the abutment pins 26 to clear the carrying plate 14 on which the gripping elements 16 are mounted, the carrying plate has arcuate recesses or bays 36 in its outer edge, in the neighborhood of the respective gripping elements, as best seen in FIGS. 9 and 10. Of course the abutment pins of the group 26 are clear of the gripping elements when the directional control device is in its U position.

The downwardly projecting abutment pins 27 of the other group on the rotatable plate 22 are so positioned radially and axially on that plate that they are at all times clear of the gripping elements when the plate 22 is in its N position; but when it is in its U (upward) position of rotation, illustrated in FIG. 10, each of those pins 27 can be engaged by a radially inner portion of one of the gripping elements 16 therebeneath. Such engagement of course occurs as the carrying plate 14 nears the top of its upward stroke, and the carrying plate has arcuate slots 37 through which the pins 27 can freely pass for this engagement. As the inner end portion of each gripping element is thus swung downwardly, its outer end is swung upwardly into engagement with the bore hole surface 7, as illustrated in the lower portion of FIG. *2b* and the upper portion of FIG. *2d*.

Since the gripping element engages the bore hole surface 7 at a more or less indefinite point in its swing, and continued force should thereafter be applied to it to urge it into secure engagement with the surface 7 while the driver completes its upward stroke, the abutment pins 27 are yieldable upwardly against resilient bias. Specifically, as shown in FIG. 14, each of the abutment pins 27 comprises an upper telescoping member 29 that is fixed at its upper end to the rotatable plate 22 and a lower telescoping member 28 that is axially slideable on the lower portion of the upper telescoping member. Each of the telescoping members 28, 29 has a well that opens axially into the well in the other so that, together, those two members define a housing in which a coiled expansion spring 30 is confined. The spring 30, by reacting against the closed ends of the telescoping members, biases the lower telescoping member 28 downwardly. A pin 32, secured in the tubular wall of the lower telescoping member and projecting radially inwardly from it, rides in an axially extending slot 31 in the tubular wall of the upper telescoping member 29 and engages the bottom of that slot to define a lower limit of spring biased motion of the lower member 28.

The abutment pins 34, 35 on each directional control device 21 project upwardly from its lower rotatable plate 23 and, as best seen in FIG. 13, are arranged somewhat similarly to the upper abutment pins 26, 27 but are engaged by the undersides of the gripping elements 16 as the carrying plate 14 approaches the end of its downward stroke. Specifically, when the directional control device 21 is in its U (upward) position of rotation, one of the abutment pins 34 can engage the underside of each gripping element at a location thereon that is spaced radially inwardly from its swinging axis, to thus swing the outer end of the gripping element downwardly away from engagement with the bore hole surface 7, as illustrated in the upper portion of FIG. *2b* and the lower portion of FIG. *2d*. When the directional control device 21 is in its N (downward) position of rotation, the abutment pins 35 align with the respective gripping elements and, as the carrying plate 14 nears the end of its downward stroke, the underside of each of its gripping elements is engaged by one of those abutment pins, outwardly of its swinging axis. This causes the outer end of each gripping element to swing upwardly and into engagement with the bore hole surface 7, as illustrated in the upper part of FIG. 2*a* and the lower part of FIG. 2*c*. Again, since the engagement of a gripping element against the bore hole surface occurs at a somewhat indeterminate point in its swing, and requires continued application of bias to the gripping element through the remainder of the driver stroke, the abutment pins 35 are axially yieldable and are essentially identical in construction to the abutment pins 27.

It will be observed that when the directional control device 21 is in its N (downward) position, the gripping elements are engaged near their outer ends by the rigid downwardly projecting abutment pins 26 on the upper rotatable plate 22 and by the yielding upwardly projecting abutment pins 35 on the lower rotatable plate 23; and when the directional device 21 is in its U position, the gripping elements are engaged near their inner ends by the yielding abutment pins 27 on the upper rotatable plate 22 and by the rigid abutment pins 34 on the lower rotatable plate 23.

As mentioned above, the outer end of each gripping element is biased to swing downwardly. However, when the gripping element is disengaged from the bore hole surface, its downward swing in response to such bias is limited, to enable the abutment pins to cooperate with it, and it remains in an attitude defined by engagement of its inner end against the underside of the carrying plate 14, as may be seen from the lower part of FIG. 2*a* and the upper part of FIG. 2*c*.

As indicated above, the rotational position N or U of the directional control device for the upper set 19 of gripping elements is always the same as that of the corresponding device 21 for the lower set 20 of gripping elements. In general, each of the upper and lower directional control devices 21 has its own pneumatic actuator 45 for rotating it to its N and U positions, but the actuators for the two devices 21 are connected to a single four-way valve 53 by which they are both controlled and which thus coordinates them.

Figure 6:
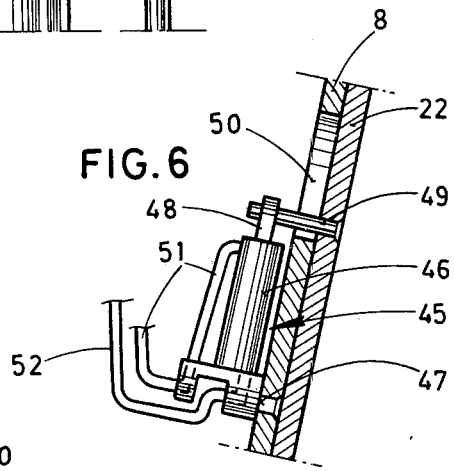
FIG. 6 is a fragmentary sectional view taken substantially on the plane of the line VI—VI in FIG. 5.
Figure 3:
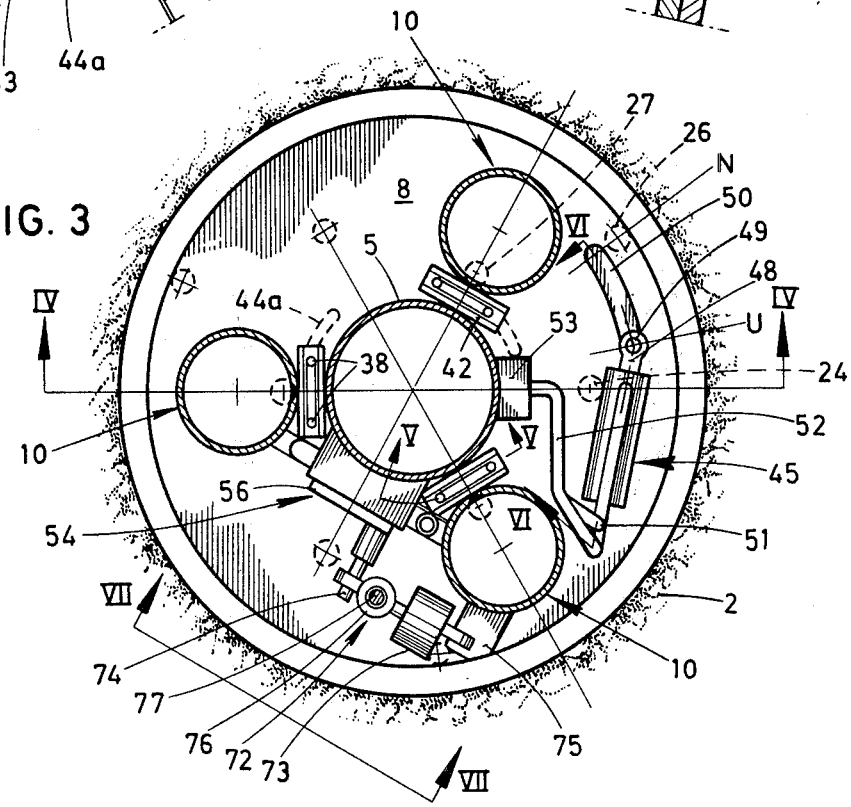
FIG. 3 is a view in cross section taken on the plane of the line III—III in FIG. 1.

FIGS. 3 and 6 show details of the actuator 45 for the upper directional control device 21, but the one for the lower directional control device is identical to it. Thus, each such actuator comprises a small double-acting cylinder motor that overlies the cylinder supporting plate 8 or 9 immediately above its directional control device and has its cylinder 46 swingably secured to that supporting plate by means of a trunnion 47 that projects upwardly from the supporting plate. The piston rod 48 of the cylinder motor 45 has its outer end swingably connected to a trunnion 49 which is fixed to the upper rotatable abutment pin plate 22 and projects upwardly through an arcuate slot 50 in the cylinder supporting plate 8. Air ducts 51, 52 lead from opposite ends of each cylinder 46 to the four-way valve 53. Details of the valve 53 are not shown because it is essentially identical with a four-way valve 54 that is described hereinafter. However, it will be understood that the valve 53 has two positions, in one of which it causes the cylinder motors 45 to swing the directional control devices to their N positions and in the other of which said motors are caused to swing said devices to their U positions. The position of the valve 53 is remotely controllable from the surface of the earth, as explained hereinafter. The valve 53 can be located on the duct section 5, above the supporting plate 8, and can have a pressure air inlet opening to the bore hole externally of the duct 4 and an exhaust air outlet communicated with the interior of the duct section 5.

The second four-way valve 54, illustrated in FIGS. 2*a*–2*b*, 2*c*–2*d*, 3 and 7, controls the operation of the cylinder motors 10 that actuate the gripping elements 16. The control valve 54 can also be located on the duct section 5, above the cylinder supporting plate 8, and can have a pressure air inlet 60 that opens to the bore hole externally of the duct 4 and an exhaust outlet 63 that is communicated with the interior of the duct section 5 through a remotely controllable shut-off valve 64. The pressure air inlet 60 is preferably provided with a suitable water separator and oil mist lubricator 61.

The four-way valve 54 comprises a housing 55 that has four ports 59, 62, 65, 65*a* in its cylindrical side wall, at the top, bottom and sides thereof. A drum 56 that is rotatable inside the housing has two right angle passages 57, 58 that can be aligned with the housing ports in either of two positions of rotation of the drum. As shown, the top housing port 59 is connected with the pressure air inlet 60, and the bottom housing port 62 is connected with the exhaust air outlet 63 that leads to the interior of the duct section 5. The left hand housing port 65 is connected with a duct 66 from which first branch passages 67 extend to the lower (rod) ends of the cylinders 11 for the upper set 19 of gripping elements. The duct 66 extends down beyond the first branch passages 67 and communicates with second branch passages 68 that open to the upper ends of the cylinders 11 for the lower set 20 of gripping elements. The right-hand port 65*a* of the four-way valve 54 is connected with a second duct 69 which has a first set of branch passages 70 that connect with the upper ends of the upper cylinders 11 and a second set of branch passages 71 that connect with the lower ends of the lower set of cylinders 11.

It will be apparent that when the exhaust air outlet 63 is blocked by the remotely controllable shut-off valve 64, the cylinder motors 10 can not operate. The shut-off valve is normally biased to such a blocking condition, but it opens upon receipt of a signal from the surface and remains open as long as it continues to receive that signal. As explained hereinafter, the signal can be a sound tone of a predetermined frequency, and the shut-off valve comprises apparatus which detects and responds to sound of that frequency, such apparatus being known and therefore not illustrated.

Figure 7:
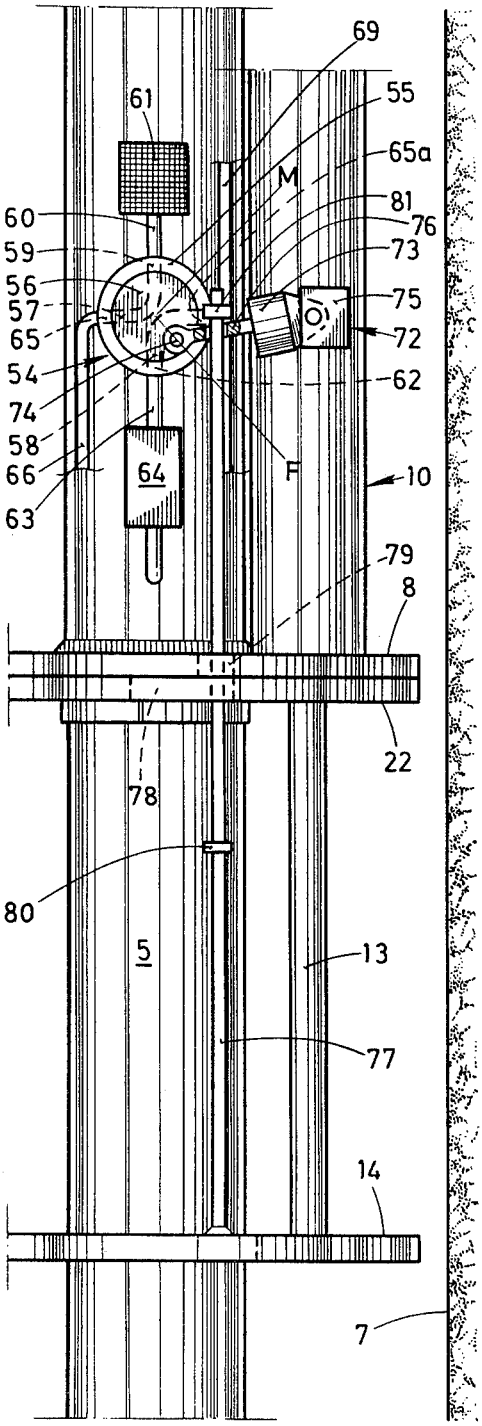
FIG. 7 is a fragmentary view in side elevation, seen in the direction denoted by the line VII—VII in FIG. 3.

So long as the shut-off valve 64 is in an open condition, the cylinder motors 10 remain in operation, automatically reversing their direction of motion at the end of each stroke by reason of an automatic shifting of the rotational position of the drum 56 of the four-way control valve 54. Such automatic shifting is effected by a lost motion connection between the cylinder motors 11 and the control valve drum 56, comprising, as best seen in FIG. 7, an axially yielding toggle member 72, extending more or less horizontally and connected with the drum 56, and a vertical rod 77 which has its lower end connected to the upper gripping element carrying plate 14 and which has lengthwise spaced apart abutment dogs 80, 81 that alternately engage the toggle member 72 to actuate it as the rod 77 is carried up and down by the carrying plate 14 to which it is attached. The toggle member comprises a pair of telescoping elements, one of which is a spring chamber 73 that provides for lengthwise extension and contraction of the toggle link and biases it towards its extended condition. At one end, the toggle link is pivotally connected to a pin 74 which is eccentrically secured in the valve drum 56 and extends parallel to the drum axis. The other end of the link is pivotally secured to a stationary bearing support 75 that is fixed to the cylinder of one of the motors 10 (see FIG. 3). The medial portion of the link is formed as a ring 76 through which the vertical rod 77 extends for its lengthwise up and down motion. The upper and lower surfaces of the ring portion 76 serve as abutments against which the dogs 81 and 80 can respectively engage. Thus, as the pistons 12 of the upper set of cylinder motors approach the end of an upward stroke, the lower dog 80 on the rod 77 engages the underside of the toggle link, swinging that link upward and thereby shifting the valve drum 56 from its angular position F shown in FIG. 7, through 90° to its alternate position M, in which it connects the upper cylinder motors 10 for a downward piston stroke. At the end of a downward stroke, the upper dog 81 on the rod 77 engages the upper side of the toggle link, swinging it down and thus shifting the valve drum through 90° back to its F position at which the upper set of motors is again connected for an upward stroke.

Thus, as long as the cut-off valve 64 remains open, the cylinder motors 10 will remain in operation, the upper motors always moving oppositely to the lower ones, and all of the motors always being reversed simultaneously at the end of each stroke. The direction in which the device will move along the bore hole as a result of such operation of the motors, whether upwardly or downwardly, will depend upon the rotational position of the directional control device 21, as governed by its four-way control valve 53. From the foregoing explanation concerning the motor control valve 54, it will be apparent that the four-way valve 53 can be biased to one of its positions (e.g., the N position for downward movement of the device 3) and can be actuated to its other position by any suitable remote control apparatus, as for example a small pneumatic servo (not shown) controlled by a signal-responsive shut-off valve (not shown), so that the absence of a directional control signal will cause the device 3 to move downward as long as it receives a "move" command signal of one frequency and to move upwardly if receipt of that "move" signal is accompanied by receipt of an "up" signal of another frequency.

It may be noted at this point that the drilling mechanism 3*a* can be similarly controlled, being stopped when no signal is received by it and caused to operate as long as it receives a continuous "drill" command signal of a third frequency.

An automatic "move" command signal generator at the bottom of the duct 4 can be arranged to begin emission of a "move" signal whenever the telescoping connection 4*b* between the duct and the drilling mechanism is fully extended, and to terminate that signal when the telescoping connection is fully contracted. The duct is thus caused to move down automatically when and as necessary to keep up with downward progress of the drilling mechanism.

The duct 4 can serve to carry all command signals to all of the devices 3 and to the drilling mechanism. Inasmuch as sound waves are propagated through a steel structure at a velocity of about 5,300 m/sec., the several devices 3 along the length of the duct 4 can thus be operated substantially in unison. To the extent that the devices 3 are not started and stopped exactly simultaneously, owing to differences in the time when they receive signals traveling along the duct, a certain amount of cushioning is provided by the elasticity of air in the opposite end portions of the motor cylinders 11. Because of this same cushioning, an extremely long duct, weighing hundreds of tons, can be supported from the side surface of a bore hole by devices 3 at regular intervals along its length. Each device along the duct supports only a part of the total weight of the duct, but every device supports its proportionate share of that weight.

For a complete understanding of the operation of the device 3, let it be assumed that the device is stationary, with its lower group 20 of gripping elements engaged with a bore hole surface and with the pistons 12 of the cylinder motors at positions intermediate the ends of their strokes. The control valve 54 is assumed to be in its position illustrated in FIG. 2*c*–2*d*, and the shut-off valve 64 is closed. Therefore the duct rests on a cushion of air trapped above the pistons 12 of the lower cylinders.

If, now, a "move" signal is received, not accompanied by an "up" signal, the shut-off valve 64 opens, releasing the air trapped in the upper ends of the lower cylinders and the lower ends of the upper cylinders. The cushion of air disappears, and, instead, the trapped air flows to the low-pressure interior of the duct section 5, as the lower cylinders 11 move down relative to their pistons 12 and the upper pistons move downward in their cylinders 11. By such piston movement, the duct section 5 is lowered relative to the carrying plate 14 for the engaged lower group 20 of gripping elements, and the carrying plate 14 with the disengaged upper group 19 of gripping elements is moved down relative to the bore hole as well as relative to the duct section 5. The relative movements between the cylinders and pistons of the two sets of air motors are synchronized by the endless cables 38 and are aided by flow of pressure air into the lower ends of the lower cylinders and the upper ends of the upper cylinders.

Since no "up" signal was received, the directional control devices 21 are in their N (downward) positions, in which the upper rigid abutment pins 26 and the lower resilient abutment pins 35 are aligned with the gripping elements.

Figures 2A, 2B, 2C, 2D:
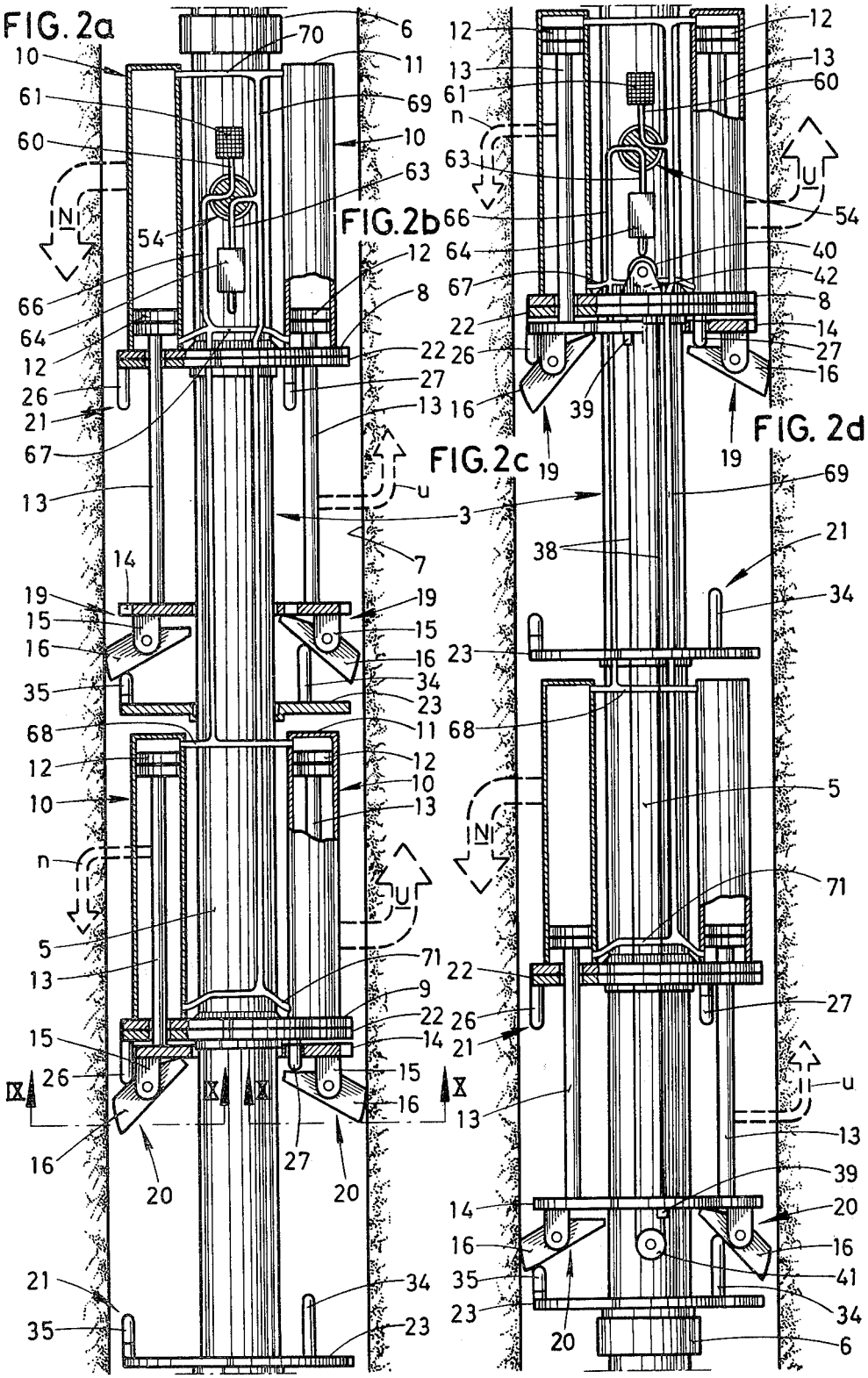
Figure 4:
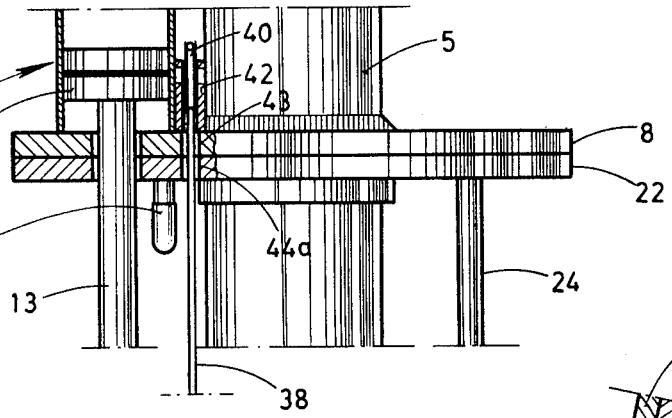
FIG. 4 is a fragmentary view in longitudinal section taken substantially on the plane of the line IV—IV in FIG. 3.
Figure 5:
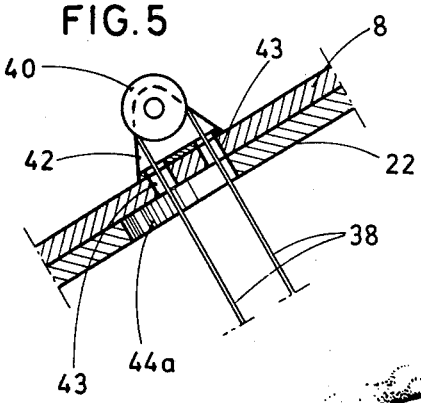
FIG. 5 is a fragmentary view taken substantially on the plane of the line V—V in FIG. 3.

As the carrying plate 14 that carries the upper group 19 of gripping elements reaches the end of its downward stroke, those gripping elements, as shown in FIG. 2*a*, are brought into engagement with the upwardly projecting yielding abutment pins 35 of the upper directional control device and are thereby swung out into engagement with the bore hole surface. Very soon thereafter, the gripping elements of the lower group 20 are disengaged from the bore hole surface by downwardly projecting rigid abutment pins 26 of the lower directional control device, which pins are brought down upon the outer end of those gripping element as the cylinders 11 of the lower air motors are in the final part of their downward movement. The position of the drum 56 of the four-way control valve 54 is shifted near the end of the stroke just described, and the apparatus is thus in the condition shown in FIG. 2*a*–2*b* when that stroke is ended.

Now pressure air flows into the bottom of the upper cylinders and the tops of the lower cylinders, while exhaust air flows out of the upper ends of the upper cylinders and the lower ends of the bottom cylinders.

The cylinders 11 of the upper motors, and with them the duct section 5, therefore descend relative to the engaged upper group 19 of gripping elements, as indicated by the large arrow N in FIG. 2*a;* and at the same time the group 20 of lower gripping elements, which are out of engagement with the bore hole surface, move down with the lower pistons 12 relative to the duct 5 and relative to the bore hole surface. As this stroke ends, the gripping elements of the lower group 20 engage the upwardly projecting yielding abutment pins 35 of the lower directional control device and are swung into engagement with the bore wall surface, while the rigid downwardly projecting abutment pins 26 of the upper directional control device come down onto the gripping elements of the upper group 19 and drive them downwardly out of engagement with the bore hole surface. At the same time, the position of the four-way valve is again shifted, to feed pressure air to the upper ends of the upper cylinders and the lower ends of the lower cylinders, and to vent the lower ends of the upper cylinders and upper ends of the lower cylinders, for the beginning of a new cycle, with the condition of the apparatus being as shown in FIG. 2*c*. Such operation of the device continues until the "move" signal terminates and the shut-off valve 64 is thereby closed.

During downward movement, the air being exhausted from the contracting cylinder ends to the interior of the duct section 5 is not vented unrestrictedly but is instead released slowly enough so that descent of the duct section is controlled or braked. Since the carrying plates 14 of the two drivers are tied together by means of the endless cable 38, the "idle" driver (having its gripping elements disengaged) cooperates in producing this braking or cushioning of descent.

If an "up" signal is received by the device 3 along with a "move" signal, the directional control devices 21 shift to their U positions, in which upper yielding abutment pins 27 and lower rigid abutment pins 34 align with the gripping elements. It is now assumed that the two drivers are intermediate the ends of their strokes, the upper gripping elements 19 are engaged with the bore hole surface, and the valve 54 is in its condition illustrated in FIG. 2*c*–2*d*. Upon opening of the shut-off valve 64, pressure air from the bore hole forces its way into the upper portion of the upper cylinders 11, lifting those cylinders (and with them the duct section 5) relative to the engaged gripping elements 19. Pressure air also forces its way to the undersides of the pistons 12 of the lower cylinders, raising those pistons relative to the bore hole surface as well as relative to the duct section 5 and thus raising the disengaged gripping elements of the lower group 20. Meanwhile, air is vented to the interior of the duct section 5 from the lower portion of the upper cylinders and the upper portion of the lower cylinders. As this stroke is ending, the lower gripping elements 20 are raised into engagement with the bore hole surface by the lower downwardly projecting resilient abutment pins 27, and immediately thereafter the upper upwardly projecting rigid abutment pins 34, which are moving upwardly with the rotatable plate 23 and the duct section 5, engage the upper gripping elements 19 to release them from the bore hole surface. At the end of this stroke the drum of the four-way valve 54 is shifted, and the apparatus is now in the condition illustrated in FIG. 2*b*.

Pressure air now flows into the upper ends of the lower cylinders 11, so that those cylinders are raised, and with them the duct 5. Pressure air also flows into the lower ends of the upper cylinders, thus raising their pistons 12 and consequently lifting the disengaged upper gripping elements 19 relative to the duct section 5 as well as relative to the bore hole surface. Near the end of this stroke, the upper gripping elements 19 are carried into engagement with the upper downwardly projecting yieldable abutment pins 27 and are thus swung into biting engagement with the bore hole surface. Immediately afterward, the lower rotatable plate 23, carried by the upwardly moving duct section 5, brings its rigid, upwardly projecting abutment pins 34 into engagement with the lower gripping elements 20, swinging them away from the bore hole surface. As this stroke ends, the four-way control valve is again reset for a new stroke in the opposite direction, and thereupon the apparatus is in the condition shown in FIG. 2*d* and the cycle is repeated.

In the upper portion of a bore hole the air is likely to be very humid, whereas at depths in excess of 6,000 meters the air has relatively low humidity by reason of being heated to temperatures of 300°–450° C. It will be apparent that the apparatus of this invention is adapted for operation under these extreme environmental conditions.

Those skilled in the art will appreciate that the invention can be embodied in forms other than as herein disclosed for purposes of illustration.

The invention is defined by the following claims

I claim:

1. A device whereby a load such as a duct section, having an axis that can substantially coincide with a bore hole axis, can be supported from the side surface of a bore hole, and whereby said load can be alternatively and selectively confined against motion in response to a force that urges it axially in one direction or can be moved along the bore hole in said one direction or in the opposite axial direction, said device comprising:

A. two groups of gripping elements, each gripping element
   (1) having an outer end portion which can bitingly engage a bore hole surface, and
   (2) being mounted for limited swinging about a swinging axis which is transverse to said load axis, by which swinging said outer end portion is carried in a surface-engaging direction, obliquely away from the load axis and in said opposite axial direction, and in an opposite surface-disengaging direction,
   (3) each of said gripping elements being biased in its surface-disengaging direction;

B. a pair of reciprocable drivers, one for each group of gripping elements, said drivers and their respective groups of gripping elements being spaced from one another along the load axis and each of said drivers being connected between its group of gripping elements and the load and arranged to move its group of gripping elements relative to the load through defined strokes in opposite axial directions;

C. coordinating means connected to both of said reciprocable drivers to constrain them to synchronized motion wherein each driver carries its group of gripping elements in the axial direction opposite to that in which the other group of gripping elements is being carried and the two drivers simultaneously begin and end their respective strokes; and D. a directional control device movable in directions substantially transverse to the load axis between a pair of defined positions, said directional control device comprising two groups of abutment members that are formed and arranged for engagement with the gripping elements near the ends of their strokes, to swing gripping elements that are out of engagement with the bore hole surface in their surface-engaging direction and to swing gripping elements that are engaged with said surface in their surface-disengaging direction, (1) one of said groups of abutment members being arranged for engagement of the gripping elements when the directional control device is in one of its said positions and effecting such engagement and disengagement between the gripping elements and the bore hole surface as enables the drivers to move the load in said one axial direction, and (2) the other of said groups of abutment members being arranged for engagement of the gripping elements when the directional control device is in the other of its said positions and effecting such engagement and disengagement between the gripping elements and the bore hole surface as enables the drivers to move the load in said opposite axial direction.

2. The device of claim 1, further characterized by:

E. a control device which so controls energization of the drivers as to determine the prevailing direction of their strokes and which comprises a member movable in opposite directions between a pair of defined limits that respectively correspond to the respective stroke directions of one of the drivers; and F. means providing a lost motion connection between said one driver and said member of the control device, whereby said driver shifts said member from one of its said limits to the other as said driver reaches the end of each of its strokes, to enable the driver to be energized for an immediately following stroke in the opposite direction.

3. The device of claim 2 wherein each of said drivers comprises a double acting pneumatic cylinder motor and wherein said control device comprises a four-way valve having a pressure air inlet connection, an exhaust air outlet connection, and a pair of connections to the cylinder of each cylinder motor, further characterized by:

G. a normally closed shut-off valve connected with said exhaust air outlet connection to normally block flow of return air from the cylinders and thus prevent operation of the drivers but which can be opened to cause the drivers to operate.

* * * * *

UNITED STATES PATENT AND TRADEMARK OFFICE

CERTIFICATE OF CORRECTION

PATENT NO. : 4,141,414

DATED : February 27, 1979

INVENTOR(S) : Sven H. Johansson

It is certified that error appears in the above-identified patent and that said Letters Patent are hereby corrected as shown below:

Col. 6, line 46, "the" (first occurrence) should be --they--

Replace sheet 2 of the drawings with the accompanying two sheets of drawings containing Figs. 2a-2d.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,141,414

DATED : February 27, 1979

INVENTOR(S) : Sven H. Johansson

It is certified that error appears in the above-identified patent and that said Letters Patent are hereby corrected as shown below:

The inventor's correct address is:

Enelund, Vårdsberg, S-585 90

Linköping, Sweden

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*